US011123245B2

(12) United States Patent
Yeh

(10) Patent No.: US 11,123,245 B2
(45) Date of Patent: Sep. 21, 2021

(54) SIT TO STAND FUNCTIONAL EXERCISER

(71) Applicant: PREVENTIVE MEDICAL HEALTH CARE CO., LTD., Taichung (TW)

(72) Inventor: Ching-Yu Yeh, Taichung (TW)

(73) Assignee: PREVENTIVE MEDICAL HEALTH CARE CO., LTD., Taichung (TW)

( * ) Notice: Subject to any disclaimer, the term of this patent is extended or adjusted under 35 U.S.C. 154(b) by 31 days.

(21) Appl. No.: 16/737,878

(22) Filed: Jan. 8, 2020

(65) Prior Publication Data

US 2020/0214917 A1 Jul. 9, 2020

(30) Foreign Application Priority Data

Jan. 9, 2019 (TW) ..... 108100891

(51) Int. Cl.
*A61G 5/14* (2006.01)
*A63B 21/00* (2006.01)
*A63B 23/04* (2006.01)

(52) U.S. Cl.
CPC ..... *A61G 5/14* (2013.01); *A63B 21/00181* (2013.01); *A63B 23/0405* (2013.01); *A61G 2200/34* (2013.01); *A63B 2208/0228* (2013.01)

(58) Field of Classification Search
CPC ..... A61G 5/14; A61G 5/1067; A61G 5/104; A61G 5/1056; A61G 5/1059; A61G 5/006; A61G 2200/34; A61G 2200/36; A61H 1/00; A61H 1/02; A61H 1/0237–0244; A61H 1/0255; A61H 2201/0138; A61H 2201/0149; A61H 2201/1253; A61H 2201/1261; A61H 2201/1284; A61H 2201/1409; A61H 2201/1633; A61H 2201/1664; A61H 2201/1676; A61H 2203/04; A61H 2203/0418; A61H 2205/088; A61H 2205/10; A61H 2205/102; A61H 2205/104; A61H 2205/106;
(Continued)

(56) References Cited

U.S. PATENT DOCUMENTS 5,695,434 A * 12/1997 Dalebout ..... A63B 21/0083 482/72
7,000,988 B2 * 2/2006 Bressler ..... A61G 5/14 297/313

(Continued)

FOREIGN PATENT DOCUMENTS

| | | |
|---|---|---|
| CN | 204744707 U | 11/2015 |
| TW | M492101 U | 12/2014 |
| TW | M495144 U | 2/2015 |

*Primary Examiner* — Megan Anderson
*Assistant Examiner* — Kathleen Vermillera
(74) *Attorney, Agent, or Firm* — CKC & Partners Co., LLC

(57) ABSTRACT

A sit to stand functional exerciser includes a main base body, a seat mechanism, a linking mechanism and an assisting force adjusting mechanism. The linking mechanism is linked with the seat mechanism and includes a connecting base, a main linking shaft and a secondary linking shaft. The assisting force adjusting mechanism is linked with the seat mechanism and includes a main linking casing, an assisting force setting rail and a positioning assembly. The assisting force setting rail includes a plurality of concaves. The positioning assembly is selectively positioned in one of the concaves so as to adjust a predetermined assisting force.

11 Claims, 11 Drawing Sheets

(58) Field of Classification Search
CPC ..... A61H 2205/108; A63B 23/0405; A63B 21/008; A63B 21/0083; A63B 21/0085; A63B 21/0087; A63B 21/0088; A63B 21/00181; A63B 2023/0411; A63B 2208/0228; A63B 2071/025; A63B 2225/093
See application file for complete search history.

(56) References Cited

U.S. PATENT DOCUMENTS

| | | | | |
|---|---|---|---|---|
| 8,151,812 | B2 * | 4/2012 | Razon | A61H 3/04 135/66 |
| 9,375,607 | B1 * | 6/2016 | Rayman | A63B 21/00181 |
| 9,662,536 | B1 * | 5/2017 | Lin | A63B 21/0552 |
| 9,999,800 | B2 * | 6/2018 | Lin | A63B 23/03575 |
| 10,376,734 | B1 * | 8/2019 | Razon | A63B 22/0046 |
| 2006/0048296 | A1 * | 3/2006 | Sutou | A61G 7/1094 4/667 |
| 2007/0037679 | A1 * | 2/2007 | Geeting | A63B 21/4035 482/130 |
| 2012/0126601 | A1 * | 5/2012 | Smith | A61G 5/14 297/339 |
| 2017/0252602 | A1 * | 9/2017 | Lefkovitz | A63B 21/4039 |
| 2020/0009421 | A1 * | 1/2020 | Ku | A63B 23/0405 |

* cited by examiner

SIT TO STAND FUNCTIONAL EXERCISER

RELATED APPLICATIONS

This application claims priority to Taiwan Application Serial Number 108100891, filed Jan. 9, 2019, which is herein incorporated by reference.

BACKGROUND

Technical Field

The present disclosure relates to a rehabilitating equipment. More particularly, the present disclosure relates to a sit to stand functional exerciser.

Description of Related Art

In recent years, the social pattern is gradually entering an aging society. The government and the private institutions have paid more attention to the care and the needs of the elderly. The development of medical equipment, nursing appliances and even daily necessities for the elderly is more multiple.

For the elderly, the most common problem is the gradual inconvenience of the action. As the aforementioned situation gets serious, or the physiological diseases aggravate the inconvenience of movement, the opportunities of walking or standing is get fewer, and the muscles and the joints of the lower body are easily degraded due to infrequent use. Therefore, there is a need for rehabilitating equipment providing the elderly to practice the basic exercises on the lower body in a stability environment that does not require excessive movement.

SUMMARY

According to one embodiment of the present disclosure, a sit to stand functional exerciser includes a main base body, a seat mechanism, a linking mechanism and an assisting force adjusting mechanism. The seat mechanism includes a bottom tube and a seat body. The seat body is connected to one end of the bottom tube. The linking mechanism is linked with the seat mechanism and includes a connecting base, a main linking shaft and a secondary linking shaft. The connecting base is disposed on the main base body. The main linking shaft is a pneumatic rod. One end of the main linking shaft is linked with the seat mechanism, and the other end of the main linking shaft is pivotally connected to the connecting base. One end of the secondary linking shaft is linked with the seat mechanism and the other end of the secondary linking shaft is pivotally connected to the connecting base. The assisting force adjusting mechanism is linked with the seat mechanism and includes a main linking casing, an assisting force setting rail and a positioning assembly. The main linking casing is for disposing the bottom tube of the seat mechanism therein. One end of the assisting force setting rail is connected to the main linking casing, the other end of the assisting force setting rail is pivotally connected to the main base body, and the assisting force setting rail includes a plurality of concaves. The positioning assembly is connected to the end of the main linking shaft being linked with the seat mechanism. The positioning assembly is selectively positioned in one of the concaves so as to adjust a predetermined assisting force provided by the main linking shaft.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
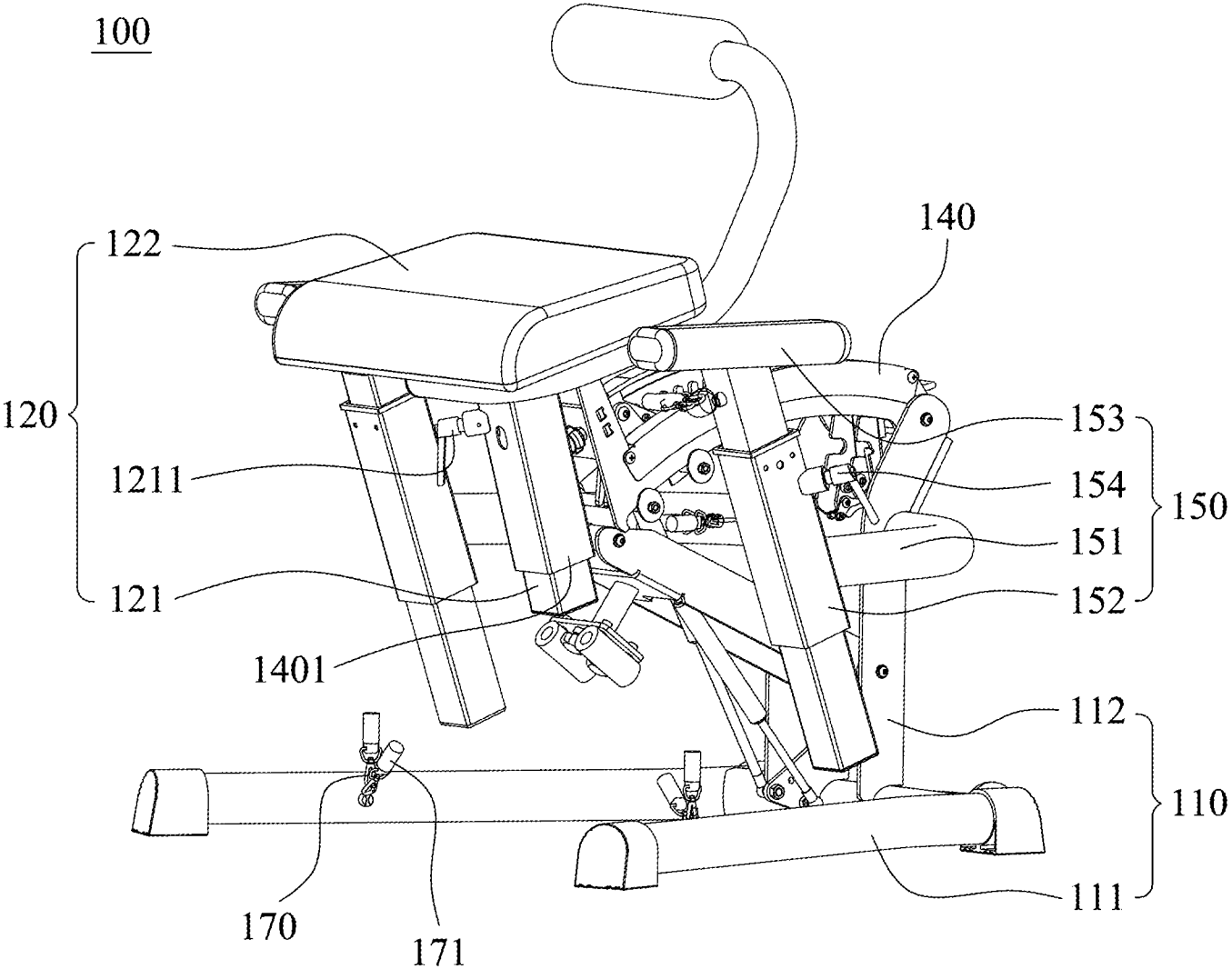
FIG. 1 is a three-dimensional view of a sit to stand functional exerciser according to one embodiment of the present disclosure.

FIG. 1 is a three-dimensional view of a sit to stand functional exerciser 100 according to one embodiment of the present disclosure. In FIG. 1, the sit to stand functional exerciser 100 includes a main base body 110, a seat mechanism 120, a linking mechanism 130 and an assisting force adjusting mechanism 140. The linking mechanism 130 and the assisting force adjusting mechanism 140 are disposed on the main base body 110. The linking mechanism 130 and the assisting force adjusting mechanism 140 are linked with the seat mechanism 120. When a user sits on the seat mechanism 120 and applies a downward force, the linking mechanism 130 is driven to gradually bring the user into a sitting posture; when the user stands up from the sitting posture, the linking mechanism 130 provides a predetermined assisting force to provide the user a thrust force via the seat mechanism 120, so as to help the user smoothly return to a standing posture. Therefore, it is favorable for the elderly or the rehabilitating person to perform the training or rehabilitation of the conversion of the standing posture and the sitting posture. The predetermined assisting force of the linking mechanism 130 can be adjusted by the assisting force adjusting mechanism 140, so that the sit to stand functional exerciser 100 can provide the users in difference needs and levels, and expand the application range of the sit to stand functional exerciser 100.

Figure 2:
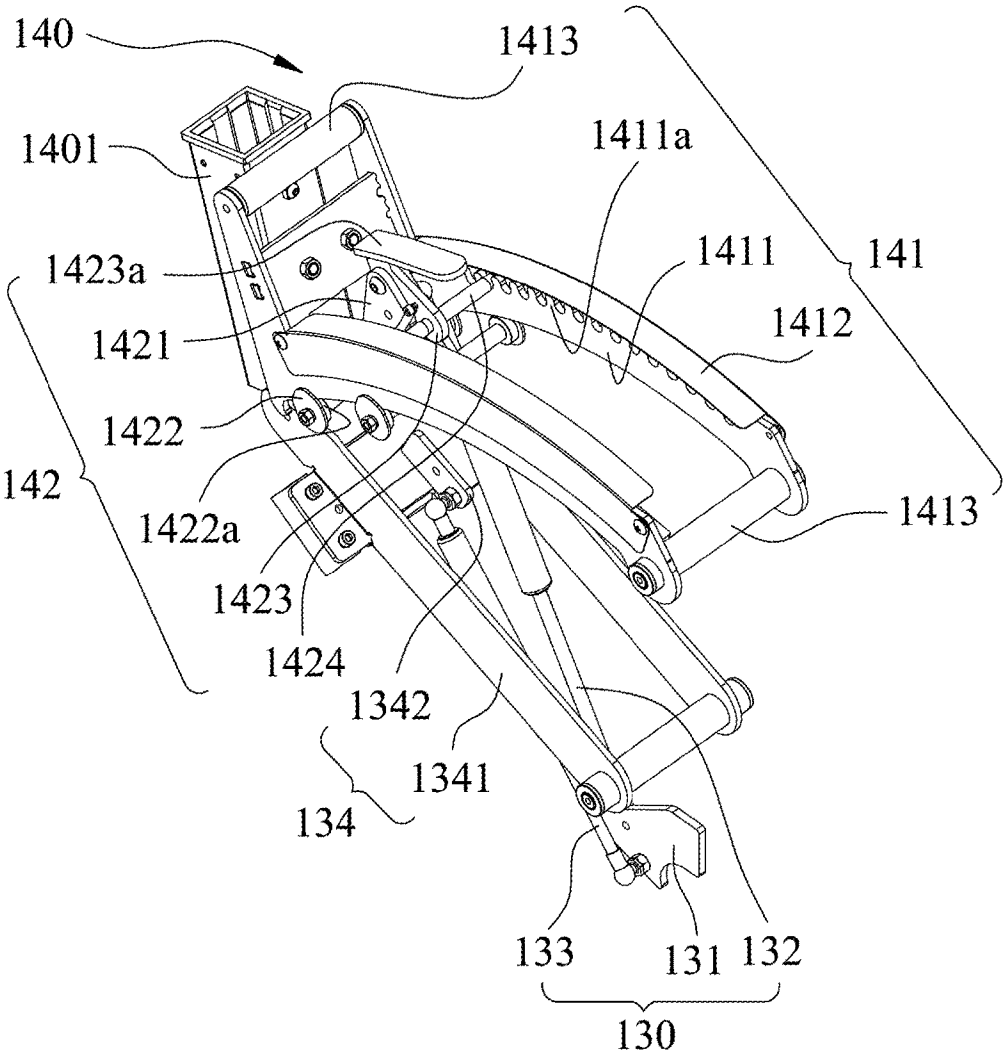
FIG. 2 is a schematic view of the linking mechanism and the assisting force adjusting mechanism according to the embodiment of FIG. 1.
Figure 3:
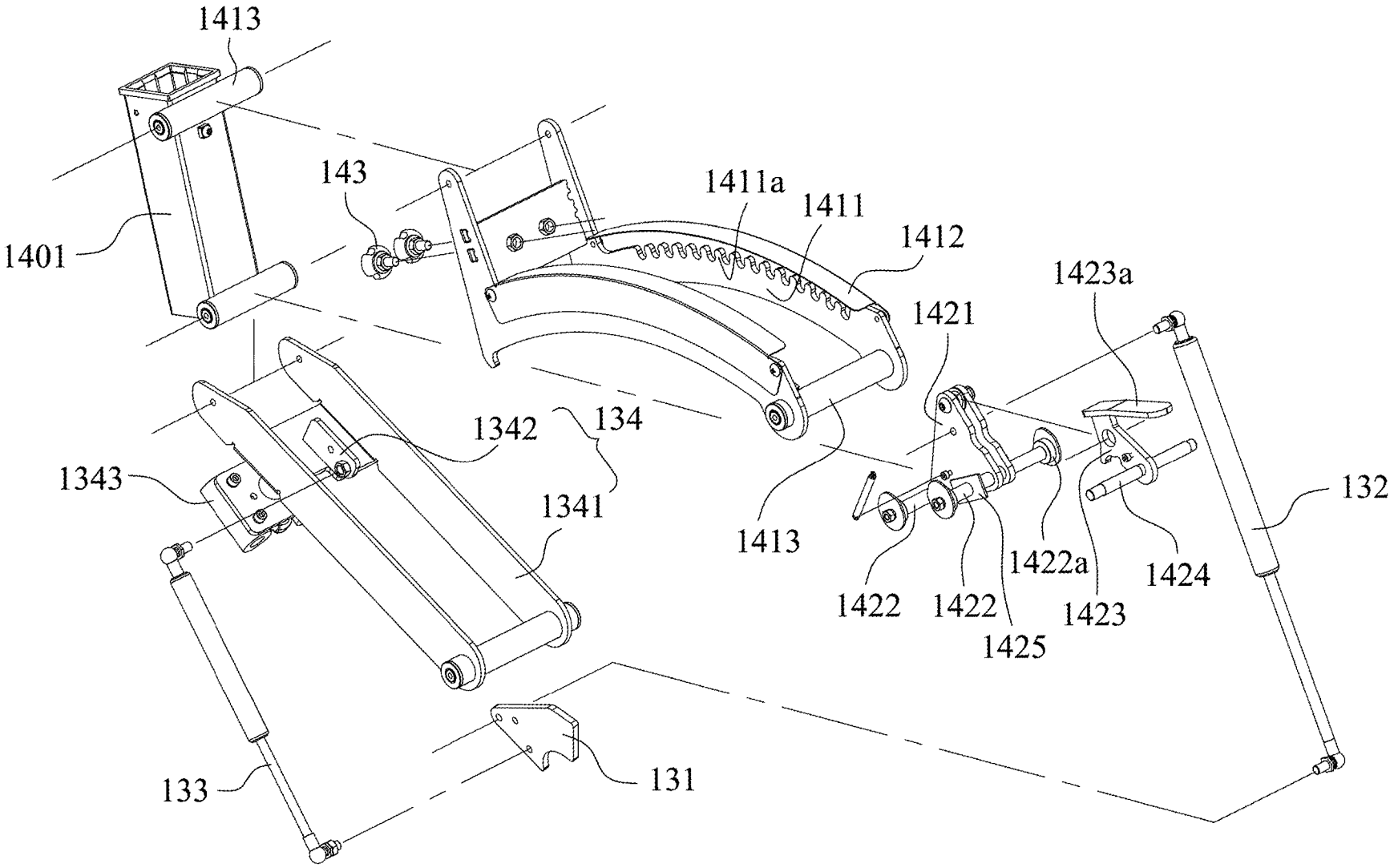
FIG. 3 is an exploded view of the linking mechanism and the assisting force adjusting mechanism of FIG. 2.

FIG. 2 is a schematic view of the linking mechanism 130 and the assisting force adjusting mechanism 140 of according to the embodiment FIG. 1. FIG. 3 is an exploded view of the linking mechanism 130 and the assisting force adjusting mechanism 140 of FIG. 2. As shown in FIGS. 1, 2 and 3, the seat mechanism 120 includes a bottom tube 121 and a seat body 122, wherein the seat body 122 is connected to one end of the bottom tube 121. The assisting force adjusting mechanism 140 includes a main linking casing 1401, an assisting force setting rail 141 and a positioning assembly 142. The main linking casing 1401 is for disposing the bottom tube 121 of the seat mechanism 120 therein and is connected to the assisting force setting rail 141. The positioning assembly 142 is disposed on the assisting force setting rail 141. The linking mechanism 130 is connected and linked with the assisting force adjusting mechanism 140.

In detail, the linking mechanism 130 includes a connecting base 131, a main linking shaft 132 and a secondary linking shaft 133. The connecting base 131 is disposed on the main base body 110. The main linking shaft 132 is a pneumatic rod. One end of the main linking shaft 132 is connected to the seat mechanism 120 so as to link with the positioning assembly 142 of the assisting force setting rail 141. The other end of the main linking shaft 132 is pivotally connected to the connecting base 131. One end of the secondary linking shaft 133 is connected to the main linking casing 1401 so as to link with the seat mechanism 120. The other end of the secondary linking shaft 133 is pivotally connected to the connecting base 131.

One end of the assisting force setting rail 141 is connected to the main linking casing 1401. The other end of the assisting force setting rail 141 is pivotally connected to the main base body 110. The assisting force setting rail 141 includes a plurality of concaves 1411*a*. The main linking shaft 132 is linked with the seat mechanism 120 by connecting to the positioning assembly 142, wherein the positioning assembly 142 is selectively positioned in one of the concaves 1411*a* so as to adjust a predetermined assisting force provided by the main linking shaft 132.

In detail, the assisting force adjusting mechanism 141 includes two rail elements 1411, two coverings 1412 and two linking elements 1413. Two ends of each of the rail elements 1411 are connected to each other via the two linking elements 1413. One of the linking elements 1413 is connected to the main linking casing 1401 so that the two rail elements 1411 can be linked with the seat mechanism 120. The plurality of concaves 1411*a* are disposed on a side edge of each rail elements 1411, wherein the concaves 1411*a* on the two rail elements 1411 are corresponding to each other. The coverings 1412 are connected to the rail elements 1411, respectively. The coverings 1412 cover the concaves 1411*a* of the rail elements 1411 to prevent the concaves 1411*a* being exposed and to avoid the dust accumulating on the concaves 1411*a* and affecting the stability of the positioning assembly 142. Therefore, the beauty of the sit to stand functional exerciser 100 can also be improved.

The positioning assembly 142 includes a moving wheel base 1421, two moving wheels 1422, a positioning adjustment base 1423 and an inserting element 1424. The end of the main linking shaft 132 being linked with the seat mechanism 120 is connected to the moving wheel base 1421. The moving wheels 1422 are connected to the moving wheel base 1421 and movable along a side edge of the assisting force setting rail 141. The positioning adjustment base 1423 is pivotally connected to the moving wheel base 1421 and includes a pulling member 1423*a*. The inserting element 1424 is passed through the positioning adjustment base 1423 and is for positioning in one of the concaves 1411*a*. According to the embodiment of FIGS. 2 and 3, the positioning assembly 142 is positioned between the two rail elements 1411. The main linking shaft 132 can provide the predetermined assisting force by the inserting element 1424 being engaged with corresponding concaves 1411*a*. When the inserting element 1424 is engaged with different concaves 1411*a*, the predetermined assisting force of the main linking shaft 132 can be changed.

Further, each of the moving wheels 1422 includes two bearings 1422*a* which are movable along another side edge of the two rail elements 1411. Therefore, it is favorable for improving the smoothness of moving the positioning assembly 142 when the user wants to adjust the predetermined assisting force of the main linking shaft 132.

A secondary-linking-shaft linking assembly 134 is for supporting the weight of the sit to stand functional exerciser 100 and helps the seat mechanism 120 to rebound. Furthermore, the linking mechanism 130 can further include the secondary-linking-shaft linking assembly 134 for linking the secondary linking shaft 133 and the seat mechanism 120, so as to improve the stability of the operation of the secondary linking shaft 133. The secondary-linking-shaft linking assembly 134 includes a linking base 1341. One end of the linking base 1341 is pivotally connected to the main base body 110 and the other end of the linking base 1341 is connected to the end of the secondary linking shaft 133 being linked with the seat mechanism 120. Further, the secondary-linking-shaft linking assembly 134 can further include a secondary-linking-shaft linking member 1342 connected in the linking base 1341 and for connecting to the end of the secondary linking shaft 133 being linked with the seat mechanism 120. Therefore the stability of the connection and the linkage of the sit to stand functional exerciser 100 can be improved.

Figure 4:
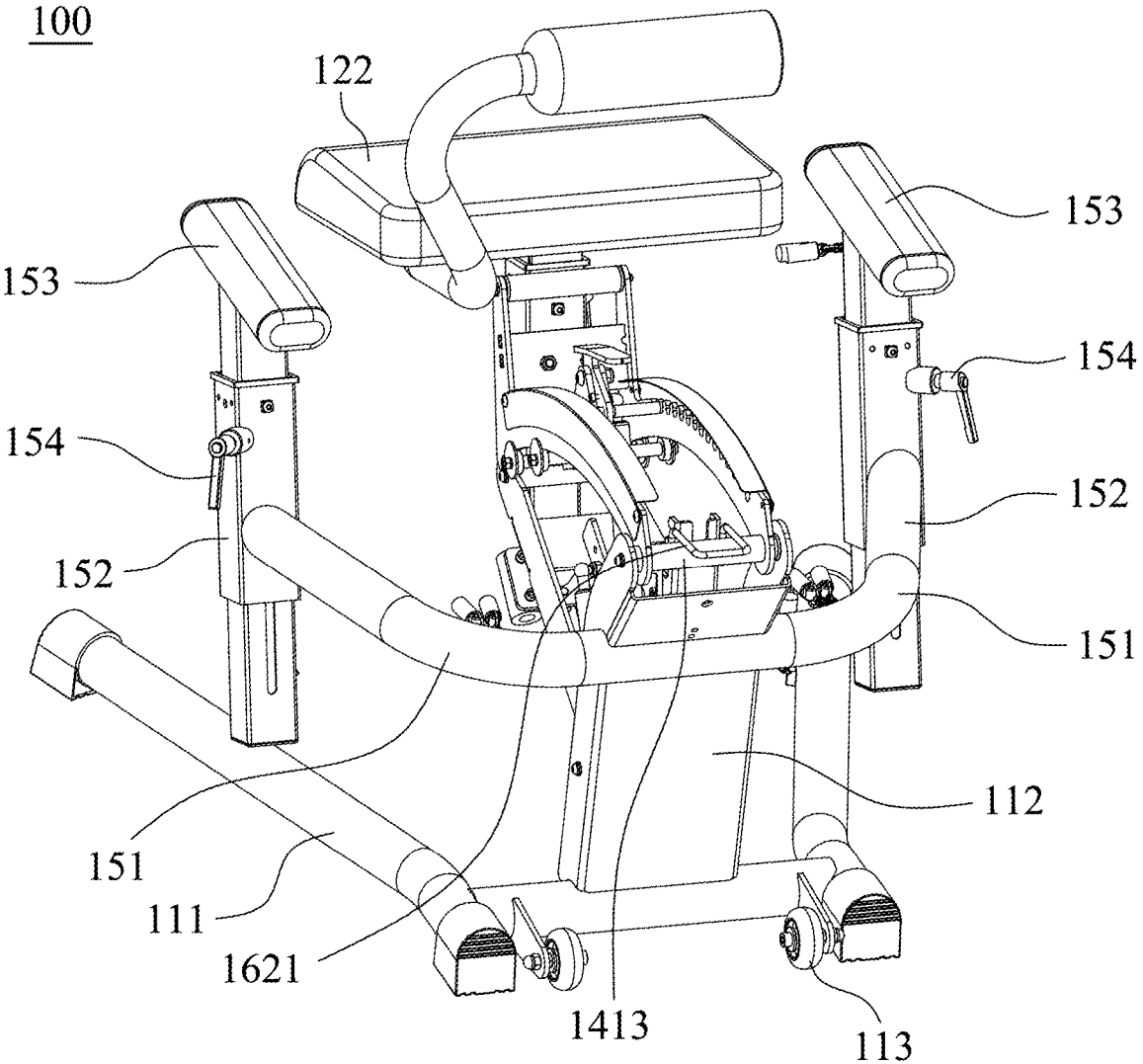
FIG. 4 is another three-dimensional view of the sit to stand functional exerciser according to the embodiment of FIG. 1.

FIG. 4 is another three-dimensional view of the sit to stand functional exerciser 100 according to the embodiment of FIG. 1. The user applies the force to the sit to stand functional exerciser 100, and the sit to stand functional exerciser 100 provides the assisting force to the user to perform the action repeatedly. Hence, the mechanism stability of the overall sit to stand functional exerciser 100 is very important. In FIG. 4, the main base body 110 of the sit to stand functional exerciser 100 can further include a base 111 and a standing base 112. The base 111 is a U-shaped, so that the sit to stand functional exerciser 100 can be stably placed on a plane. The standing base 112 can be vertically connected to the base 111. The connecting base 131 is connected to the base 111, and the assisting force setting rail 141 is pivotally connected to the standing base 112. Further, the main base body 110 can further include a plurality of bottom wheels 113 which can be connected to the base 111 for the user moving the sit to stand functional exerciser 100. Specifically, in the embodiment of FIG. 4, the number of the bottom wheels 113 is two, but the present disclosure will not be limited thereto.

As shown in FIGS. 1 and 4, the sit to stand functional exerciser 100 can further include an armrest mechanism 150 positioned on two sides of the seat mechanism 120 and including a supporting structure 151 and two armrest assemblies (its reference numeral is omitted). Each of the armrest assemblies is connected to two ends of the supporting structure 151. Each of the armrest assemblies includes a supporting casing 152 and a grip 153. The supporting casing 152 is connected to one of the ends of the supporting structure 151. The grip 153 is connected to the other one of the ends of the supporting casing 152. The grip 153 can be adjacent to the seat body 122 of the seat mechanism 120 and for supporting the user's hand when the user uses the sit to stand functional exerciser 100, so as to improve the safety in use. Further, the supporting casing 152 can further include a plurality of supporting sleeves (its reference numeral is omitted) and a height adjusting element 154. The supporting sleeves are sleeved with each other, so that the length of the supporting casing 152 can be changed, and the length of the supporting casing 152 is positioned by the height adjusting element 154, so as to change the position of the grip 153, and it would be more convenient to use by different users. In the embodiment of FIG. 1, the connecting relationship between the height adjusting element 154 and the supporting sleeves and the detailed structure can be found in the conventional art, and will not described herein.

Further, in order to provide the users with different figures to use the sit to stand functional exerciser 100, the height of the seat mechanism 120 can be also adjustable. In detail, the seat mechanism 120 can further include a height adjusting element 1211, wherein the bottom tube 121 can be moved relative to the main linking casing 1401 so as to change the height of the seat body 122. The relative position of the bottom tube 121 and the main linking casing 1401 is positioned by the height adjusting element 1211, thus it is suitable for users with different heights. In the embodiment of FIG. 1, the connecting relationship and the detailed structure of the height adjusting element 1211, the bottom tube 121 and the main linking casing 1401 can be found in the conventional art, and will not be described herein.

Figure 5A:
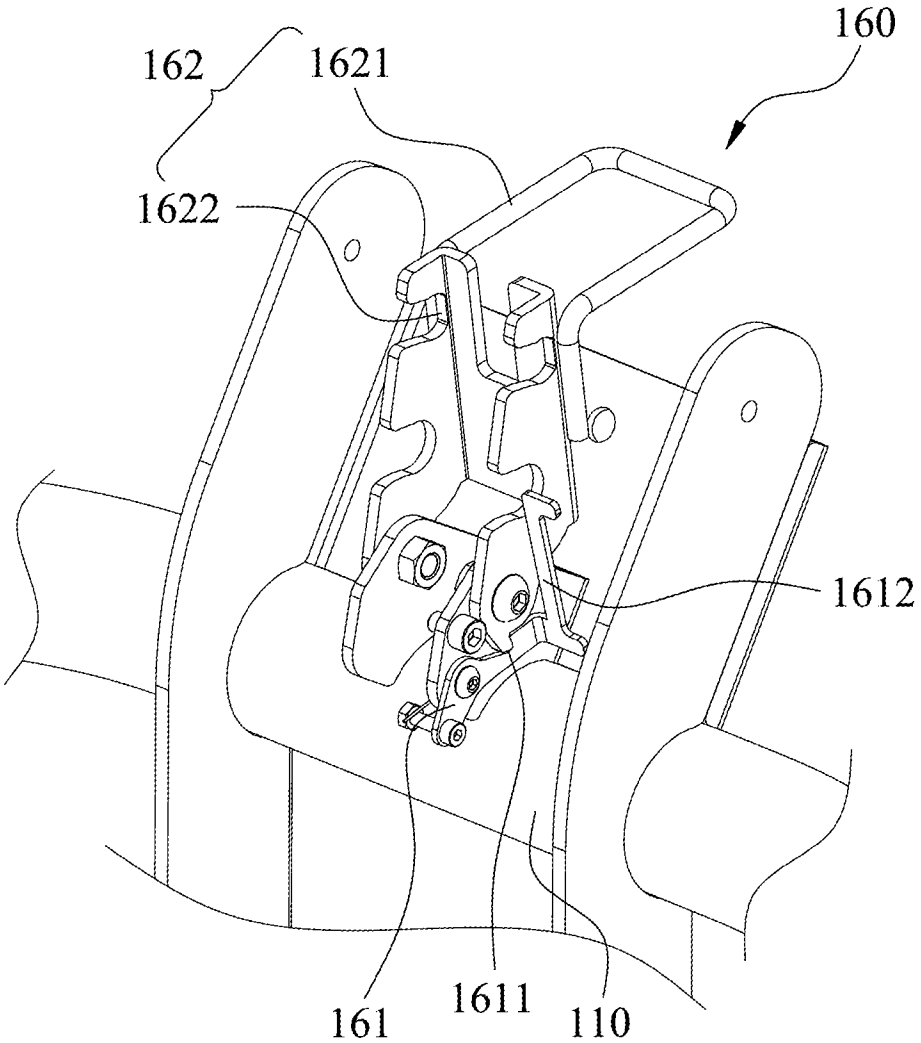
FIG. 5A is a schematic view of the limiting assembly according to the embodiment of FIG. 1.
Figure 5B:
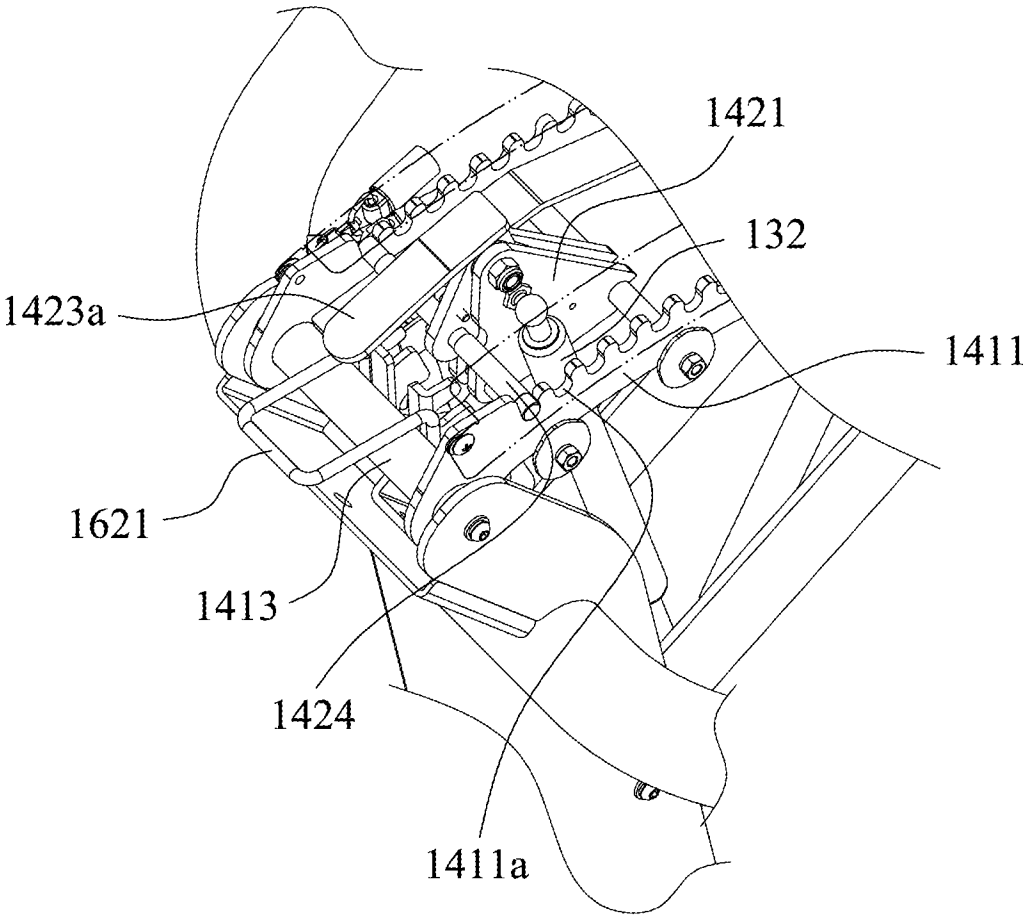
FIG. 5B is a schematic view of the handle element according to the embodiment of FIG. 1.

FIG. 5A is a schematic view of the limiting assembly 160 according to the embodiment of FIG. 1. FIG. 5B is a schematic view of the handle element 1621 according to the embodiment of FIG. 1. In FIGS. 5A and 5B, the limiting assembly 160 is for limiting the inserting element 1424, and the limiting assembly 160 includes a hooking element 161 and a limiting handle 162. The hooking element 161 is pivotally connected to the main base body 110 and includes a hooking groove 1611. The limiting handle 162 is pivotally connected to the main base body 110, one end of the limiting handle 162 is separably buckled to the hooking groove, and the other end of the limiting handle is a handle element 1621. The limiting handle 162 includes a limiting groove 1622 separably buckled to the inserting element 1424 and is for limiting the positioning adjustment base 1423 to pivot. The initial state of the seat mechanism of the conventional sit to stand functional exerciser is maintained at a high standing position, but most users who use the sit to stand functional exerciser cannot maintain the standing position. Hence, the sit to stand functional exerciser 100 of present invention can limit the seat mechanism 120 at the lowest sitting position via the limiting assembly 160, and it is convenient for the medical staff to move the user to the sit to stand functional exerciser 100, and after the user is seat stably, the limiting assembly 160 is released to let the user start standing training.

Moreover, the positioning assembly 142 can further include a pushing element 1425, and the hooking element 161 further includes a pushing portion 1612. The pushing element 1425 is for pushing against the pushing portion 1612 to pivot the hooking element 161, thus drive the hooking groove 1611 is disengaged from the end of the limiting handle 162.

Figure 6A:
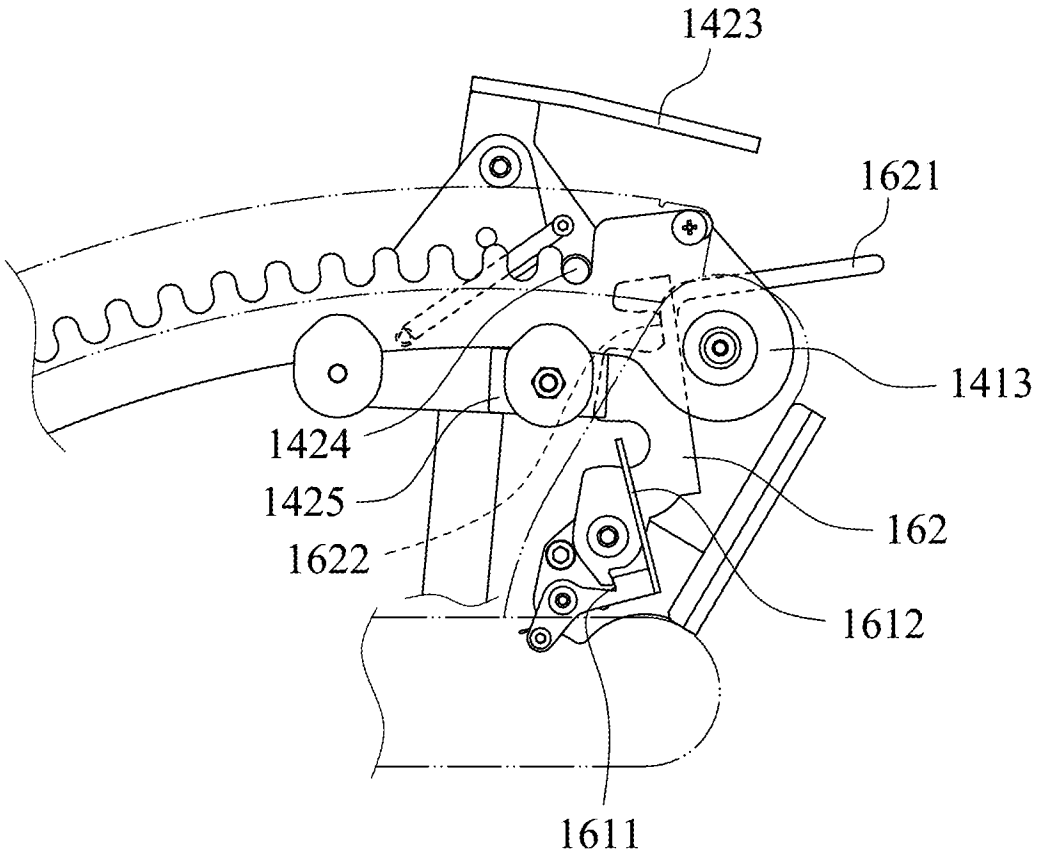
FIG. 6A is a schematic view of the limiting assembly in a using state according to the embodiment of FIG. 5A.
Figure 6B:
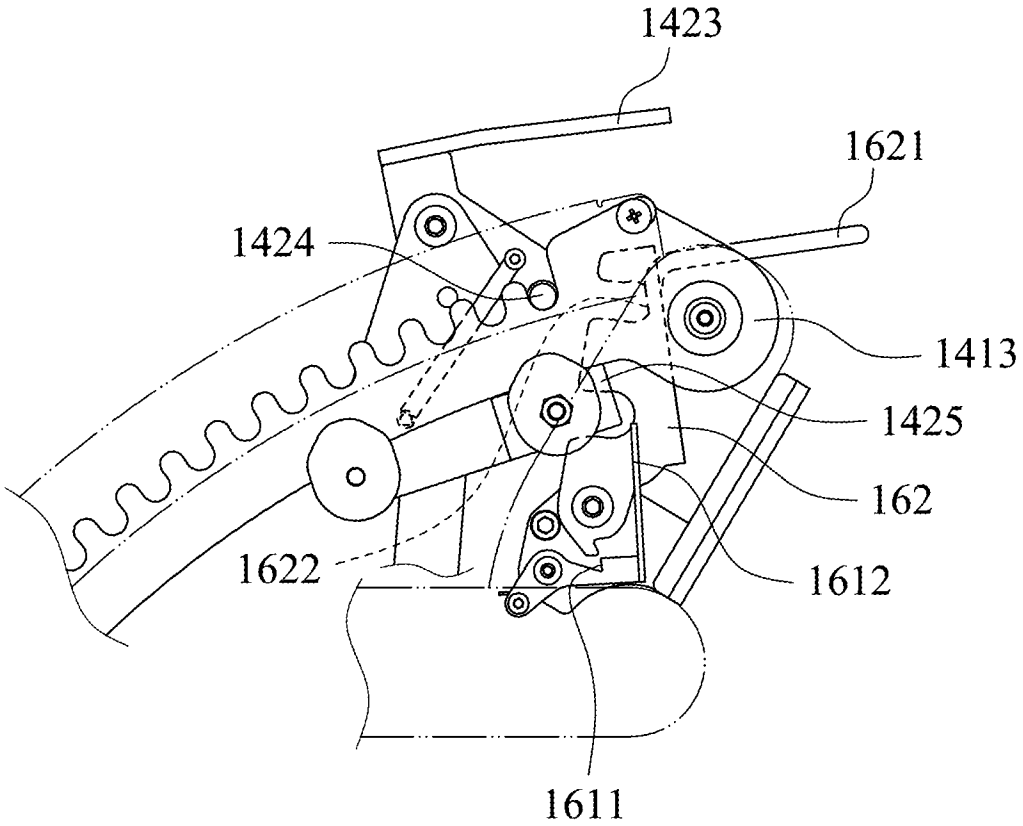
FIG. 6B is a schematic view of the limiting assembly in another using state according to the embodiment of FIG. 5A.
Figure 6C:
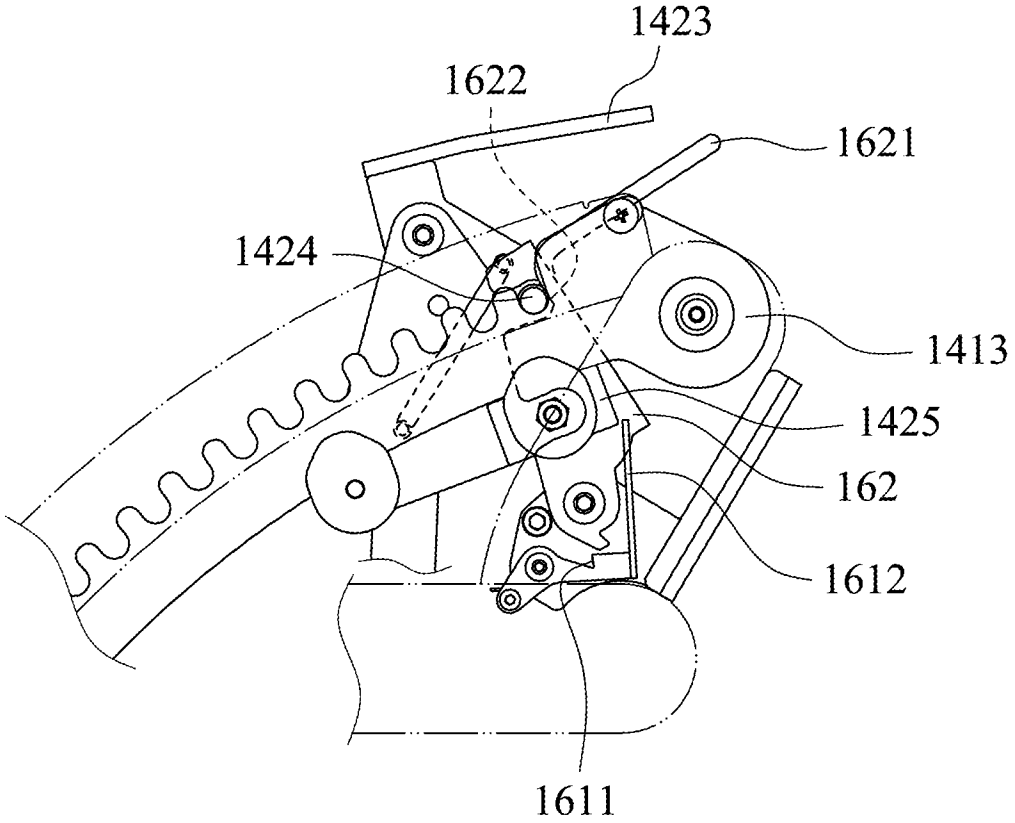
FIG. 6C is a schematic view of the limiting assembly in still another using state according to the embodiment of FIG. 5A.

FIG. 6A is a schematic view of the limiting assembly 160 in a using state according to the embodiment of FIG. 5A. FIG. 6B is a schematic view of the limiting assembly 160 in another using state of FIG. 5A. FIG. 6C is a schematic view of the limiting assembly 160 in still another using state according to the embodiment of FIG. 5A. As shown in FIG. 6A, the end of the limiting handle 162 of the limiting assembly 160 is buckled to the hooking groove 1611, and the handle element 1621 is buckled to the linking elements 1413 when the inserting element 1424 is positioned in the different position of the concaves 1411*a* via the assisting force adjusting mechanism 140; at this time the limiting handle 162 is limited and cannot be pivoted. If the user wants to position the seat mechanism 120 at the lowest sitting position, the inserting element 1424 is positioned in the concave 1411*a* of the linking elements 1413 which is pivoted closest to the standing base 112. In FIG. 6B, when the user presses the seat body 122, the pushing element 1425 is for pushing against the pushing portion 1612 to pivot the hooking element 161, thus the hooking groove 1611 is disengaged from the end of the limiting handle 162, and the handle element 1621 is detached and can be pulled. In FIG. 6C, the limiting handle 162 is pivoted by the handle element 1621 so as to buckle the limiting groove 1622 to the inserting element 1424. Therefore, the seat body 122 is limited at the lowest sitting position without being rose by the restoring force of the main linking shaft 132, and the user can sit thereon stably.

Furthermore, in order to provide more multiple application range of the sit to stand functional exerciser 100, the sit to stand functional exerciser 100 can include an elastic rope hooking hole 170 disposed on the main base body 110 and for connecting an elastic rope 171. Therefore, the user can connect the elastic rope 171 to the elastic rope hooking hole 170 on demand, and then use the elastic rope 171 to train during using the sit to stand functional exerciser 100.

Figure 7:
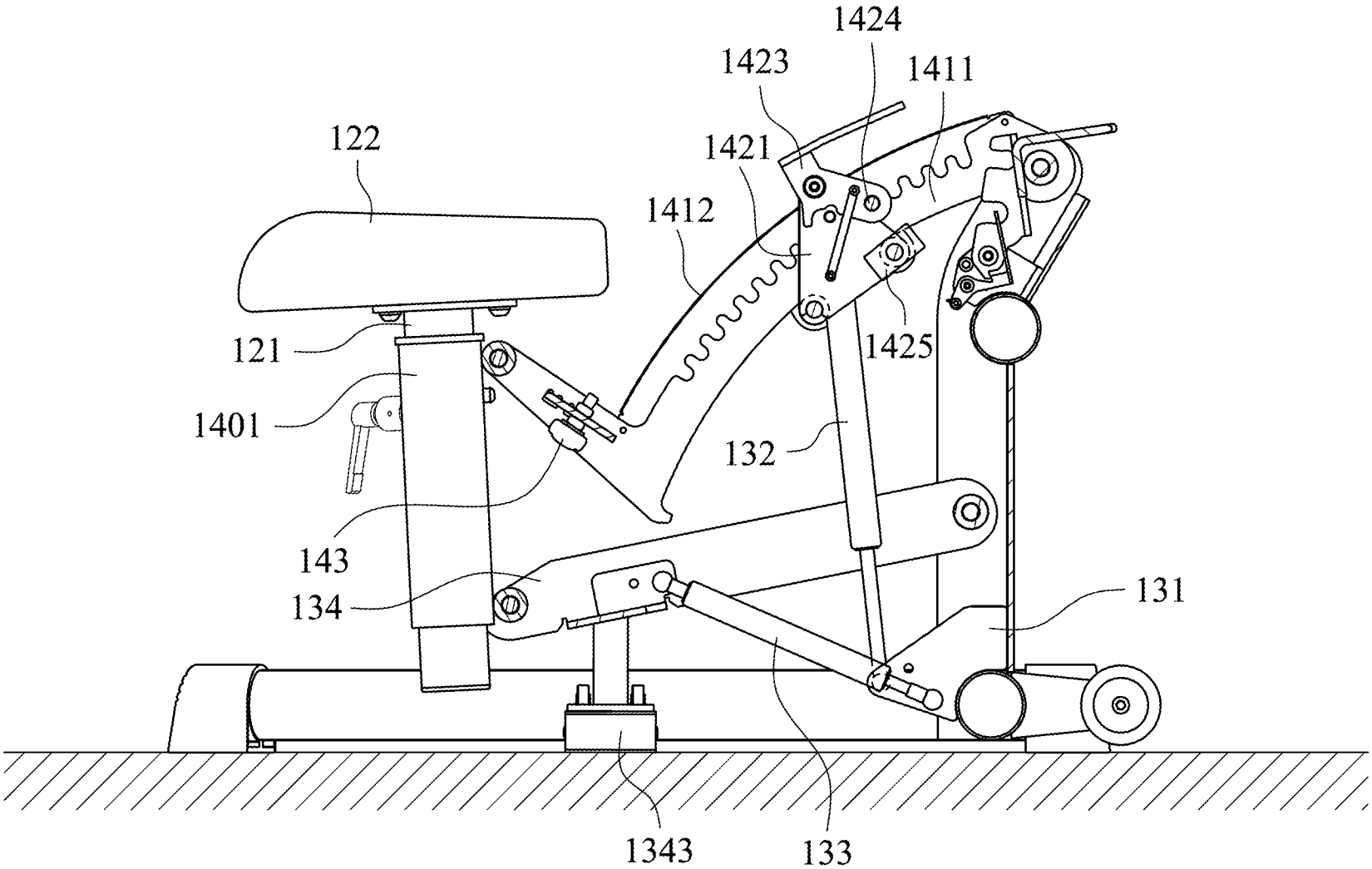
FIG. 7 is a side view of the sit to stand functional exerciser according to the embodiment of FIG. 1.

FIG. 7 is a side view of the sit to stand functional exerciser 100 of according to the embodiment FIG. 1. As shown in FIG. 7, the secondary-linking-shaft linking assembly 134 can further include a supporting element 1343 connected to the linking base 1341 and for abutting against a ground. Therefore, when the sit to stand functional exerciser 100 is pressed by the user and is in the sitting position, the supporting element 1343 abuts against the ground to provide the user can sit thereon more stably and so as to increase the safety thereof.

Figure 8:
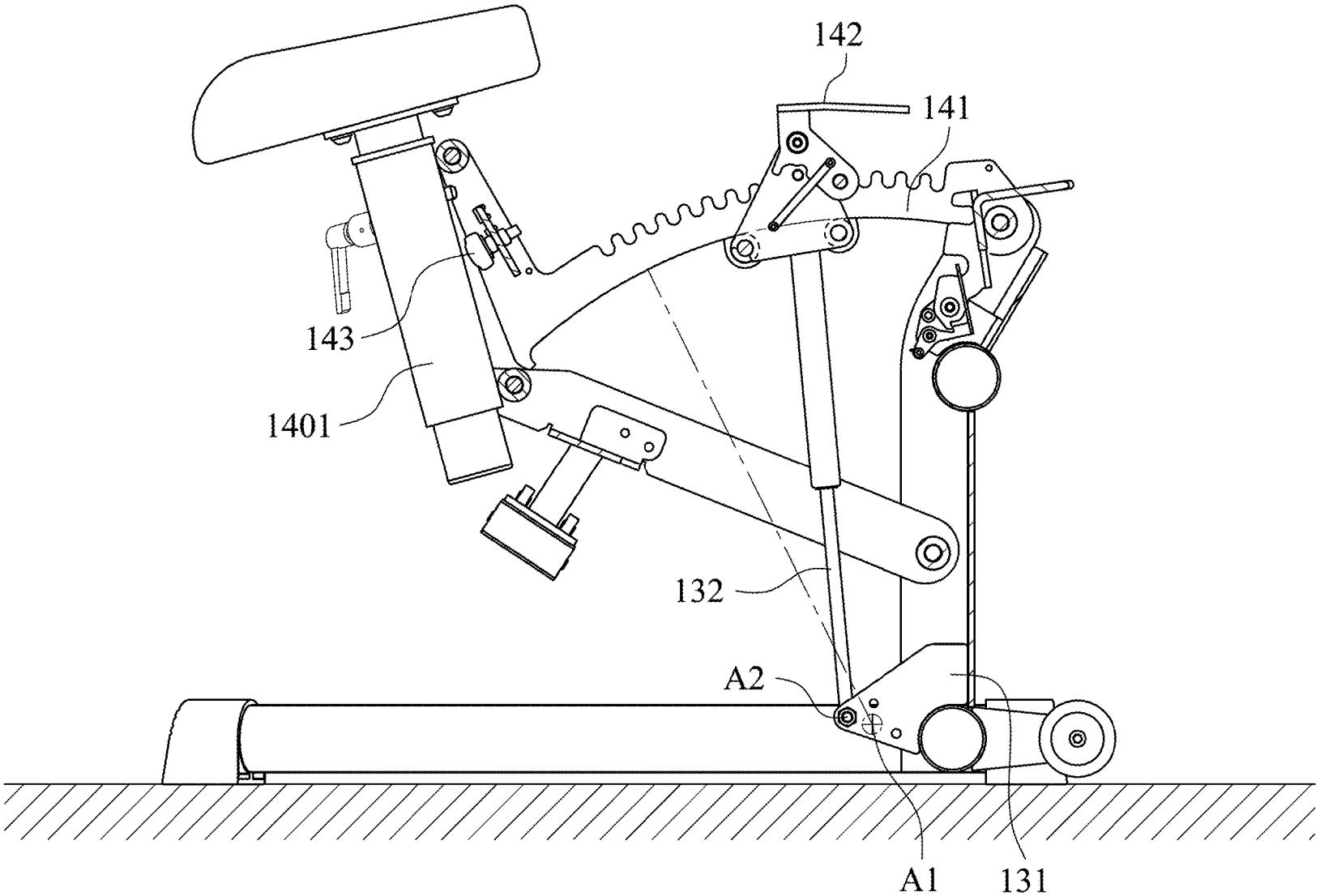
FIG. 8 is another side view of the sit to stand functional exerciser according to the embodiment of FIG. 1.

FIG. 8 is another side view of the sit to stand functional exerciser 100 according to the embodiment of FIG. 1. As shown in FIG. 8, the assisting force adjusting mechanism 140 can further include at least one pad 143 disposed on the end of the assisting force setting rail 141 being connected to the main linking casing 1401. The pad 143 is positioned between to the assisting force setting rail 141 and the main linking casing 1401. Specifically, in FIG. 8, the number of the pad 143 is two, but is not limited thereto. The pad 143 can adjust the position of the assisting force setting rail 141 by abutting against the main linking casing 1401. Since the assisting force setting rail 141 is arc-shaped, when the relative position of the assisting force setting rail 141 and the main linking casing 1401 is changed, an center of curvature A1 extended by the assisting force setting rail 141 to the connecting base 131 is also displaced.

In detail, the other end of the main linking shaft 132 is pivotally connected to the connecting base 131 via a connecting axis A2. By the arrangement of the pad 143, the center of curvature A1 of the assisting force setting rail 141 is concentric with the connecting axis A2. That is, the arcuate path of the positioning assembly 142 liking the main linking shaft 132 to displace will be the same as the arcuate path of the assisting force setting rail 141. Hence, the displacement of the positioning assembly 142 can be more smoothly, and the operation of the positioning assembly 142 is not affected by the difference between the arcuate path of the displacement of the positioning assembly 142 and the assisting force setting rail 141 being too large.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A sit to stand functional exerciser, comprising:

a main base body;

a seat mechanism comprising:

a bottom tube; and a seat body connected to one end of the bottom tube;

a linking mechanism linked with the seat mechanism and comprising:

a connecting base disposed on the main base body;

a main linking shaft being a pneumatic rod, a first end of the main linking shaft linked with the seat mechanism, and a second end of the main linking shaft pivotally connected to the connecting base; and a secondary linking shaft, a first end of the secondary linking shaft linked with the seat mechanism, and a second end of the secondary linking shaft pivotally connected to the connecting base; and an assisting force adjusting mechanism linked with the seat mechanism and comprising:

a main linking casing for disposing the bottom tube of the seat mechanism therein;

an assisting force setting rail, a first end of the assisting force setting rail connected to the main linking casing, a second end of the assisting force setting rail pivotally connected to the main base body, and the assisting force setting rail comprising a plurality of concaves; and a positioning assembly connected to the first end of the main linking shaft being linked with the seat mechanism, wherein the positioning assembly is configured to be selectively positioned in one of the plurality of concaves to adjust a predetermined assisting force provided by the main linking shaft, wherein the positioning assembly comprises:

a moving wheel base connected to the first end of the main linking shaft being linked with the seat mechanism;

two moving wheels connected to the moving wheel base and movable along a side edge of the assisting force setting rail;

a positioning adjustment base pivotally connected to the moving wheel base and comprising a pulling member; and an inserting element passed through the positioning adjustment base for positioning in one of the plurality of concaves.

2. The sit to stand functional exerciser of claim 1, wherein the linking mechanism further comprises:

a secondary-linking-shaft linking assembly for linking the secondary linking shaft and the seat mechanism and comprising:

a linking base, a first end of the linking base pivotally connected to the main base body, and a second end of the linking base connected to the first end of the secondary linking shaft being linked with the seat mechanism.

3. The sit to stand functional exerciser of claim 2, wherein the secondary-linking-shaft linking assembly further comprises:

a supporting element connected to the linking base and configured for abutting against a ground.

4. The sit to stand functional exerciser of claim 1, wherein the main base body comprises:

a base connected to the connecting base; and a standing base vertically connected to the base, wherein the assisting force setting rail is pivotally disposed on the standing base.

5. The sit to stand functional exerciser of claim 4, wherein the main base body further comprises:

a plurality of bottom wheels connected to the base.

6. The sit to stand functional exerciser of claim 1, further comprising a limiting assembly for limiting the inserting element and comprising:

a hooking element pivotally connected to the main base body and comprising a hooking groove; and a limiting handle pivotally connected to the main base body, a first end of the limiting handle separably buckled to the hooking groove, a second end of the limiting handle being a handle element, wherein the limiting handle comprises a limiting groove separably buckled to the inserting element for limiting the positioning adjustment base to pivot.

7. The sit to stand functional exerciser of claim 6, wherein the positioning assembly further comprises a pushing element; and the hooking element further comprises a pushing portion, wherein the pushing element is configured for pushing against the pushing portion to pivot the hooking element, thus the hooking groove is disengaged from the first end of the limiting handle.

8. The sit to stand functional exerciser of claim 1, wherein the second end of the main linking shaft is pivotally connected to the connecting base via a connecting axis, the assisting force setting rail is arc-shaped, and a center of curvature of the assisting force setting rail is concentric with the connecting axis.

9. The sit to stand functional exerciser of claim 1, wherein the assisting force adjusting mechanism further comprises:

at least one pad disposed on the first end of the assisting force setting rail being connected to the main linking casing and positioned between the assisting force setting rail and the main linking casing.

10. The sit to stand functional exerciser of claim 1, further comprising an armrest mechanism positioned on two sides of the seat mechanism and comprising:

a supporting structure connected to the main base body; and two armrest assemblies connected to two ends of the supporting structure, respectively, and each of the two armrest assemblies comprising a supporting casing and a grip, wherein the supporting casing is connected to one of the two ends of the supporting structure, and the grip is connected to the supporting casing.

11. The sit to stand functional exerciser of claim 1, further comprising an elastic rope hooking hole disposed on the main base body for connecting an elastic rope.

* * * * *